United States Patent [19]

Palombo

[11] 4,410,113

[45] Oct. 18, 1983

[54] BOW FORMING APPARATUS

[76] Inventor: Robert Palombo, 16 Hyacinth Dr., Fords, N.J. 08863

[21] Appl. No.: 252,255

[22] Filed: Apr. 8, 1981

[51] Int. Cl.[3] ..... A41H 43/00; D04D 7/10

[52] U.S. Cl. ..... 223/46

[58] Field of Search ..... 223/46; 28/147, 149, 28/150; 428/4, 5; 26/DIG. 1; 139/292, 293

[56] References Cited

U.S. PATENT DOCUMENTS

| | | | |
|---|---|---|---|
| 524,587 | 8/1894 | Garnsey | 139/293 |
| 2,077,370 | 4/1937 | Reynolds | 223/46 |
| 2,569,943 | 10/1951 | Mitchell | 223/46 |
| 3,462,049 | 8/1969 | Smith | 223/46 |

FOREIGN PATENT DOCUMENTS

| | | | |
|---|---|---|---|
| 174142 | 2/1953 | Austria | 26/DIG. 1 |
| 38007 | 12/1930 | France | 28/147 |
| 775876 | 5/1957 | United Kingdom | 28/147 |

*Primary Examiner*—Robert Mackey

*Attorney, Agent, or Firm*—Arthur L. Plevy

[57] ABSTRACT

A bow making apparatus enables the formation of a puffy type bow and includes a top section having two longitudinal projecting tines or fingers emanating from a common base and positioned above a relatively congruent bottom member also having two projecting tines oriented in the same plane and underlying the tines of said top section, with said top and bottom members positioned one above the other and separated by a predetermined amount, manifesting a ribbon collection location. The tine configuration of said members permits the looping of a ribbon about said tines in directions parallel and transverse to said plane.

1 Claim, 11 Drawing Figures

BOW FORMING APPARATUS

BACKGROUND OF THE INVENTION

This invention relates to a bow forming apparatus and more particularly to a fixture which is used as an accessory to assist a person in forming a bow.

The prior art is replete with a number of patents and devices which depict various techniques and apparatus for forming a bow. As is known, bows which are normally formed from ribbon are in great demand for decorating gifts, floral displays, corsages and for many other purposes. In regard to this, various times of the year necessitate the hiring of competent people in order to fabricate such bows. It is understood that the appearance of a bow is important in regard to the general appearance of the item to be decorated and that the fabrication of such a bow is difficult. The prior art was cognizant of such problems and as indicated above there are many patents which relate to techniques and structures for producing bows. For example, U.S. Pat. No. 1,307,069 entitled BOW OR TASSEL MAKING AND FORMING ATTACHMENT OR DEVICE issued on June 17, 1919 to J. & W. Weismantel. This patent shows a device for making a bow and uses two elongated rods each having a pair of projecting fingers and which apparatus can make a bow with a larger outer and a smaller inner loop.

U.S. Pat. No. 1,598,310 entitled METHOD OR PROCESS OF TYING BOWS issued on Aug. 31, 1926 to T. A. Quinlan. This patent shows a method of tying or forming a bow using two pairs of pliers which are positioned in opposite directions and are used to hold the ribbon during bow formation.

U.S. Pat. No. 2,077,370 entitled BOW FORMING APPARATUS issued on Apr. 13, 1937 to R. K. Reynolds. This patent shows a fixture which consists of two resilient arms positioned on a plate above a channel and is used to assist one in forming a bow.

U.S. Pat. No. 2,521,863 entitled BOW MAKING FIXTURE issued on Sept. 12, 1950 to H. E. Mertz and shows a fixture which consists of two curved arms and a center member around which fixture the ribbon is wound to form a bow.

U.S. Pat. No. 2,569,943 entitled BOW FORMING AND TYING JIG issued on Oct. 2, 1961 to J. W. Mitchell and shows a fixture having three upstanding fingers above which the ribbon is directed to form a bow.

Various other patents such as U.S. Pat. No. 2,884,169 depict apparatus for making bows which are operated by imparting a reciprocal motion to the machine. Essentially, the above described patents show fixtures which are relatively complicated and difficult to produce and use. Certain of these devices do not lend themselve to accomodate ribbons of different widths and thicknesses. The type of bows that are utilized for ornamental purposes are puffy as compared to a flat type of bow and many of the prior art references do not accomodate the fabrication of a puffy bow.

It is therefore the object of the present invention to provide apparatus which is economical to fabricate and easy to use to thereby enable a relatively unskilled person to fabricate bows of a puffy nature employed for ornamental purpose.

BRIEF DESCRIPTION OF THE PREFERRED EMBODIMENTS

A bow making apparatus has a top planar member having first and second projecting tines or fingers separated one from the other by a given distance and extending parallel to one another and in the same plane, a bottom member also has two projecting tines relatively congruent to those of said first member, with said top and bottom members positioned one above the other and separated by a predetermined amount selected according to the width of a ribbon to be accomodated with said tine format allowing said ribbon to be continuously looped while held in a looped orientation within said apparatus by said tine configurations.

DETAILED DESCRIPTION OF THE FIGURES

Figure 1:
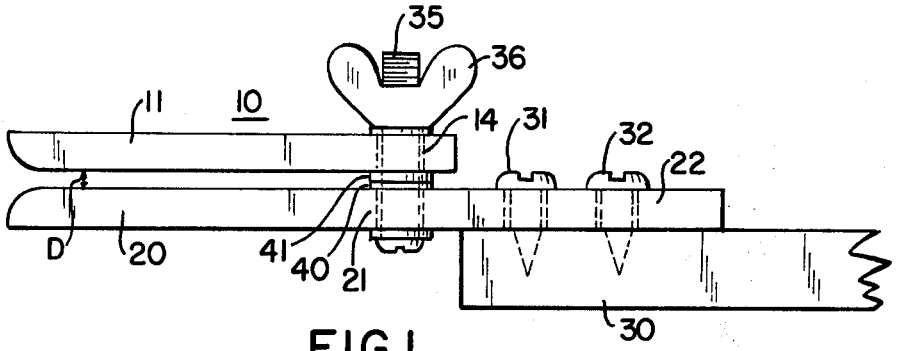
FIG. 1 is a side elevational view of a bow maker apparatus according to this invention.
Figure 2:
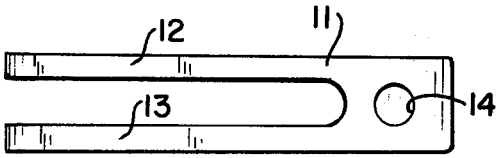
FIG. 2 is a top plan view of a top tine or projecting finger member used in this invention.

Referring to FIG. 1, there is shown a side view of a bow making apparatus 10 according to this invention. The apparatus comprises a first top member 11 which is of a fork-like configuration as shown in the top view of FIG. 2. The member 11 has a right and left tine or projecting finger 12 and 13 with an aperture 14 at the base end of the member 11 (FIG. 2). As can be seen from FIG. 2, the tines 12 and 13 are longitudinal members and are directed relatively parallel to one another and separated from one another as emanating from the common base in the same direction.

Referring back to FIG. 1, the member 11 is positioned above the bottom member 20 which has the same tine configuration as member 11 and has a corresponding aperture 21 which is coaxial with aperture 14. The base section 22 of the bottom member 20 extends beyond the base of member 14 and presents a surface for securing the fixture to the top of a table or work bench 30. Shown in FIG. 1 are two wood screws 31 and 32 which secure the device 10 to the table 30. As can be seen from FIG. 1, the members 11 and 20 are separated from each other by a predetermined distance D which is a function of the thickness of the ribbon to be employed with the device. The member 11 and 20 are held together by means of a bolt 35 inserted through apertures 14 and 21 and securing the members together by means of wing nut 36. The distance D is selected by inserting one or more washers as 40 and 41 between the members 11 and 20. Thus, as one can see, the distance can be varied according to the number of washers disposed between members 11 and 20.

FIG. 1 also shows the front ends of the tine members included in members 11 and 20 having rounded edges to facilitate easy insertion of the ribbon.

Figure 3:
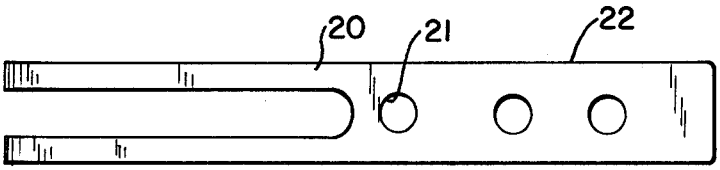
FIG. 3 is a top plan view of a bottom member.

FIG. 3 depicts a top plan view of the bottom member 20 showing the base portion 22 having the appropriate apertures. The device thus described can be fabricated from metal, wood or plastic and as described is very simple to fabricate. The device is relatively small and, for example, the top member 11 may have a length of about 3" to 4" with the bottom being about 6" in length. The width of each member may be ½" while the thickness ¼". The member thus described in conjunction with FIGS. 1 to 3 is adjustable, in that the distance D can be varied. Essentially, the distance D defines the ribbon collection space and variation in the space will allow the device to accomodate relatively narrow width ribbons as those fabricated from satin or cotton, while a wider space is necessary to accomodate bulkier ribbons like those fabricated from velvet, metal or combinations of such materials. The device shown as will be further explained, will allow a relatively unskilled person to make puffy bows using any ribbon size up to 4" in width.

Figure 4:
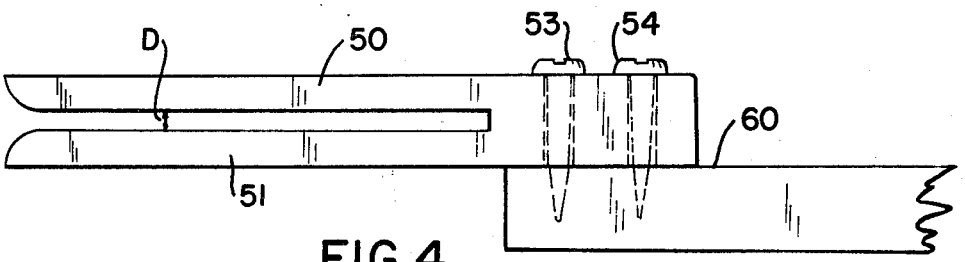
FIG. 4 is a side elevational view of an integral device according to this invention.
Figure 5:
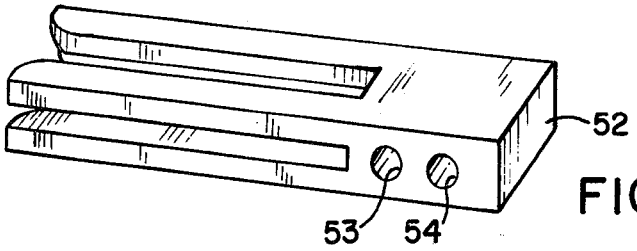
FIG. 5 is a perspective view of the device of FIG. 4.

As depicted in FIGS. 4 and 5, the device can be integrally formed whereby, the ribbon collection space D is selected as a uniform size to accomodate a relatively thick bow and for example, may be ⅛".

Referring to FIGS. 4 and 5, an upper tine member 50 and lower tine member 51 are integrally formed with a large base section 52. The base section 52 has apertures 53 and 54 which operate to secure the device to a suitable surface as 60 of FIG. 4. The device shown in FIGS. 4 and 5 can also be fabricated from the above mentioned materials and in the case of plastic can be injection molded and hence fabricated by a very simple process.

Figure 6:
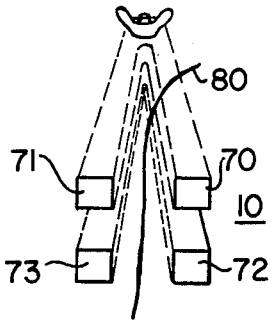
FIGS. 6 to 6D are digrammatic figures showing the formation of a bow using this apparatus.
Figure 6A:
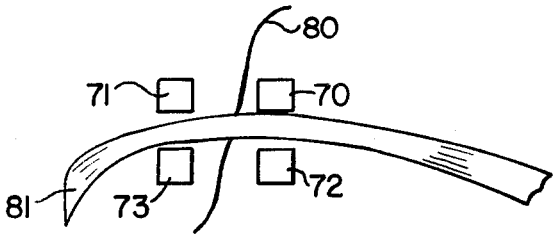
Figure 6B:
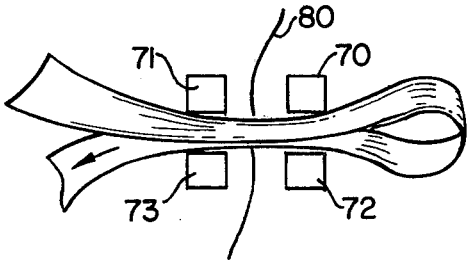
Figure 6C:
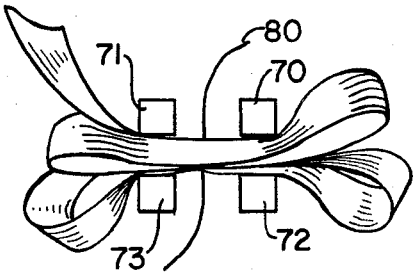
Figure 6D:
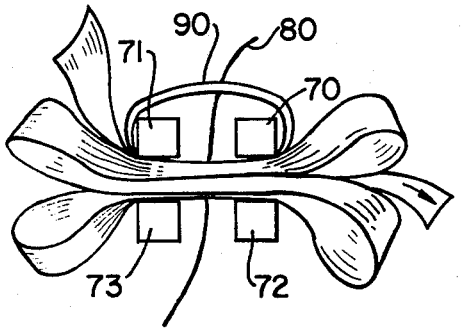
Figure 7:
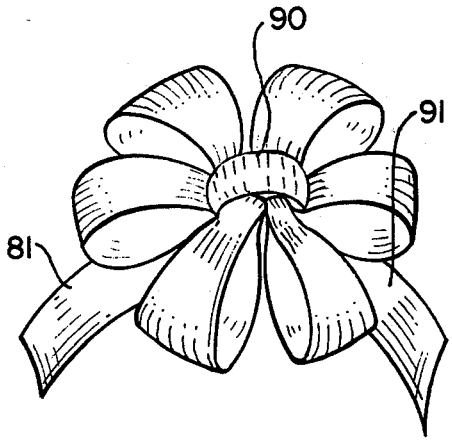
FIG. 7 is a plan view of a type of bow formed by this apparatus.

Referring to FIG. 6, there are a series of steps depicted which are useful in describing the use of the device in forming a bow. FIG. 6 shows four boxes which schematically represent the front ends of the dual tine structure depicted in FIGS. 1 to 5. The top member as 11 of FIG. 1 has a right tine 70 and a left tine 71 while the bottom member as 20 of FIG. 1 has a right tine 72 and a left tine 73. In order to form a bow, the first step implemented is to place a piece of florist wire 80 into the device 10. The wire is pushed between the tines as shown towards the base and is looped at the top to hold it in place. The user then cuts the desired length of ribbon and directs the ribbon across the ribbon collection space as shown in FIG. 6A. The user holds the tail of the ribbon with his left hand and makes a loop by again directing the ribbon through the space as shown in FIG. 6B. The ribbon is then directed back and forth through this space to make a plurality of loops as shown in FIG. 6C. Each time the loop is formed the user pushes the ribbon towards the rear or base of the unit 10 to gather the material near the wire 80. Once two loops are formed the user takes the end of the ribbon and directs it over the top of the members 70 and 71 to form a top center loop 90. The user after making the center loop 90 can then make additional loops as desired. Thus the ribbon can now include four, five or more loops and will have the general appearance shown in FIG. 7 with the top center loop 90 surrounded by relatively uniform ribbon loops. The second tail as 91 is cut. The wire 80 is then directed beneath the center loop 90 down through the center of the bow maker and twisted to surround all the ribbon gathered in the ribbon collection space. The bow is then pulled forward from the device 10 and hence removed. As one can see, as many loops can be formed as desired with the center loop 90 being formed after two or more loops have been implemented. The function of the center loop is to hide the tying wire 80 from view upon completion of the bow. If one desires to add additional pieces of ribbon to provide more tails as 80 and 91 for example, one can push strips of ribbons between the tines before tying the entire assembly together with the wire 80. Thus, as seen, one can make a very simple bow having one loop on each side with a center loop or one can make a more complicated bow having as many as 8 or 10 loops on each side. The apparatus can accomodate ribbons of varying widths and thickness in an extremely reliable manner and can be used by persons who are not skilled in making such bows with a minimum of effort. In this manner a florist or department store can employ relatively unskilled labor during a busy season as Christmas and so on to fabricate bows with a minimum of effort while further assuring that very little material is wasted during the process.

It is of course understood that certain modifications and alterations can be made in the device depicted without departing from the scope of the present invention as described above. All such modifications and changes are deemed to be encompassed by the claims which follow.

I claim:

1. Apparatus for making a bow of the puffy type, with said bow fabricated from a single length of ribbon comprising:

a top planar member having first and second projecting tines separated one from the other by a given distance and extending parallel to one another and in the same plane as directed from a common base of said top member, a bottom planar member having third and fourth projecting tines of the same dimensions as said first and second tines and also separated one from the other by said given distance, as directed from a common base of said bottom member, each of said tines having rounded surfaces facing each other, said common base of said bottom member being longer than that of said top members to allow the apparatus to be secured to a surface with said tines extending solely in the horizontal plane, with said top and bottom planar members each having a coaxial aperture in said base, support means directed through said coaxial apertures for coupling said top and bottom members together for positioning said top member above said bottom member with the top member separated from the bottom member by a predetermined amount selected according to the width of a ribbon to be accommodated, said predetermined distance being selected by adjustment means located about said apertures when said top member is positioned over said bottom member with said apertures in coaxial alignment with said adjustment means being at least one washer of a thickness selected according to the width of the ribbon to be accommodated, with said common base of the bottom planar member further including an additional aperture for securing said bottom member on a horizontal surface, whereby a ribbon can be directed transverse to said tines as well as above and below said top and bottom members to permit looping of said ribbon about said tines with said tines operative to hold said loops in place until the bow is finally formed.

* * * * *